United States Patent [19]

Hirose et al.

[11] 4,221,860

[45] Sep. 9, 1980

[54] PROCESS FOR FORMING COLOR PHOTOGRAPHIC IMAGES

[75] Inventors: Takeshi Hirose; Akia Okumura, both of Minami-ashigara, Japan

[73] Assignee: Fuji Photo Film Co., Ltd., Minami-ashigara, Japan

[21] Appl. No.: 799,036

[22] Filed: May 20, 1977

Related U.S. Application Data

[63] Continuation-in-part of Ser. No. 732,839, Oct. 18, 1976, abandoned.

[30] Foreign Application Priority Data

Oct. 20, 1975 [JP] Japan ..... 50-126139

[51] Int. Cl.[2] ..... G03C 7/16

[52] U.S. Cl. ..... 430/379; 430/351; 430/382; 430/383; 430/389; 430/471; 430/505; 430/549; 430/565

[58] Field of Search ..... 96/22, 109, 100, 74, 96/90 R, 59, 60, 63, 56.5, 55

[56] References Cited

U.S. PATENT DOCUMENTS

| | | | |
|---|---|---|---|
| 3,227,550 | 1/1966 | Whitmore et al. | 96/100 |
| 3,311,476 | 3/1967 | Loria | 96/100 |
| 4,023,970 | 5/1977 | Hellmig et al. | 96/22 |

FOREIGN PATENT DOCUMENTS

| | | | |
|---|---|---|---|
| 48-26133 | 4/1973 | Japan | 96/100 |
| 48-29432 | 4/1973 | Japan | 96/100 |
| 48-66834 | 9/1973 | Japan | 96/100 |
| 48-66835 | 9/1973 | Japan | 96/100 |
| 48-73147 | 10/1973 | Japan | 96/100 |
| 49-13576 | 4/1974 | Japan | 96/100 |

OTHER PUBLICATIONS

Mason, Photographic Processing Chemistry, Wiley & Sons, N.Y., ©1975, pp. 257–269.

*Primary Examiner*—J. Travis Brown

*Attorney, Agent, or Firm*—Sughrue, Rothwell, Mion, Zinn and Macpeak

[57] ABSTRACT

A process for forming color photographic images having improved granularity, sharpness, and gradation by applying, after image exposure, a color reversal process including a step of performing color development in the presence of a competing coupler. The element processed is a multilayer reversal color photographic material comprising a support having coated thereon at least three differently sensitive photographic silver halide emulsion layers, the outermost layer of the color photographic material being blue-sensitive and containing a nondiffusible coupler forming a yellow dye by a coupling reaction with an oxidized primary aromatic amino color developing agent and represented by the following general formula (I)

(I)

wherein $R_1$ represents an alkyl group or an aryl group; $R_2$ represents an aryl group or a heterocyclic group; and Z represents a non-metallic atom or the non-metallic atoms required to form a 4-membered ring, a 5-membered ring, or a 6-membered ring together with the moiety, one of the other two layers being green-sensitive and containing a nondiffusible coupler forming a magenta dye by a coupling reaction with an oxidized primary aromatic amino color developing agent, and the other layer being red-sensitive and containing a nondiffusible coupler forming a cyan dye by a coupling reaction with an oxidized primary aromatic amino color developing agent.

24 Claims, No Drawings

PROCESS FOR FORMING COLOR PHOTOGRAPHIC IMAGES

CROSS-REFERENCE TO RELATED APPLICATIONS

This application is a continuation-in part application of copending application Ser. No. 732,839, filed Oct. 18, 1976, now abandoned.

BACKGROUND OF THE INVENTION

1. Field of the Invention

The present invention relates to a process for forming color photographic images, more particularly, to a process for forming color photographic images by a reversal color photographic process.

2. Description of the Prior Art

Reversal color photographic processes are well known in the art and are described in, for instance, C. E. K. Mees, "The Theory of the Photographic Process", 2nd ed., Chapter 25 (1954). Reversal color photographic materials processed by such reversal color processes are generally classified into two types. In one type silver halide emulsion layers contain couplers and in the other type the silver halide emulsion layers do not contain couplers.

A reversal color photographic process fundamentally comprises a first development step with a black and white developer, a second development step with a color developer, and a desilvering step. In more detail, when an exposed reversal color photographic material is developed in the first development step, the exposed portions of the color photographic material are blackened as a result of the development but the unexposed portions thereof remain substantially unchanged. In the second development step, the silver halide in the unexposed portions is color developed to form dye images and silver images, therein while in the exposed portions the proportion of the color images formed by the color development becomes lower in proportion to the degree of exposure since the silver halide in the photographic silver halide emulsion layers was consumed in the first development step and no color image is formed in portions sufficiently exposed. The color photographic material thus developed is then processed in a desilvering step, in which developed silver is oxidized by the action of an oxidizing agent (usually called a "bleaching agent") and the oxidized silver is dissolved off from the color photographic material by a fixing agent or a silver halide complexing solvent. Thus, positive dye images are formed in the color photographic material.

The desilvering step usually comprises a bleach step and a fix step, or, alternatively, comprises a blix step (or bleach stabilization step) wherein bleaching and fixing (or stabilization) are performed simultaneously.

Processing reversal color photographic materials comprises the above-mentioned three fundamental steps, and, if desired or necessary, may further include such auxiliary steps as pre-hardening, film removal, neutralization, stopping, image stabilization, washing, etc., to retain the photographic and physical qualities of the color images, and to improve the stability of the images.

In color photography, the cleaness of the color, the fine granularity, and the sharpness of the image are fundamental and important factors for the quality of color images. Furthermore, it is desirable for color photographic films for photographic use that the photographic films have high sensitivity.

As one means for obtaining color images having fine granularity, a method is known in which the proportion of silver halide in the photographic silver halide emulsion layers is increased (see U.S. Pat. No. 2,689,793). This method, however, is accompanied by the disadvantage that the density of the dye images formed by color development greatly increases to give a hard gradation to overcome this disadvantage, it is known to incorporate competing couplers in a color developer.

The above-mentioned method of increasing the proportion of silver halide is also further accompanied by another drawback in that when this technique is applied to the upper layer or layers of multilayer color photographic materials, the sharpness of the color images formed in a lower layer or layers is decreased due to increased light scattering. As a means for overcoming this drawback, a method has been provided in which the proportion of silver halide in the photographic emulsion layer forming a yellow dye image the granularity of which is visually less sensitive is reduced and the emulsion layer is disposed as the upper layer of the color photographic material. However, when a color photographic material having such a photographic emulsion layer is developed in a color developer containing a competing coupler as indicated above, the color images formed in the yellow dye forming emulsion layer show greatly reduced density and gradation.

SUMMARY OF THE INVENTION

One object of the invention is, therefore, to provide a process for forming color photographic images by a color reversal process, which yields color images having excellent granularity, sharpness and a desired gradation.

Another object of this invention is to provide a process for forming color photographic images having excellent granularity, sharpness and a desired gradation by a color reversal process at temperatures higher than 30° C.

Further objects of this invention will become apparent from the following description.

These objects of this invention can be attained by the process of this invention as set forth below.

That is, color images having excellent granularity, sharpness and a desired gradation are formed by applying, after image exposure, a color reversal process which includes the step of performing color development in the presence of one or more competing couplers. The element processed is a color photographic material comprising a support having coated thereon at least three differently sensitive photographic silver halide emulsion layers, the outer most layer of the color photographic material being blue-sensitive and containing at least one nondiffusible coupler which forms a yellow dye by a coupling reaction with an oxidized primary aromatic amino color developing agent and represented by following general formula (I)

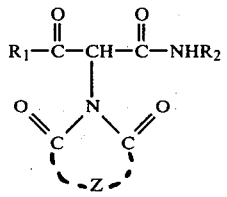

(I)

wherein $R_1$ represents an alkyl group or an aryl group; $R_2$ represents an aryl group or a heterocyclic ring; and Z represents the non-metallic atom or atoms required to form a 4-membered ring, a 5-membered ring, or a 6-membered ring together with the

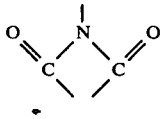

moiety, at least one of the other emulsion layers being green-sensitive and containing a nondiffusible coupler forming a magenta dye by a coupling reaction with an oxidized primary aromatic amino color developing agent, and at least one other emulsion layer being red-sensitive and containing a nondiffusible coupler forming a cyan dye by a coupling reaction with an oxidized primary aromatic amino color developing agent.

DESCRIPTION OF THE PREFERRED EMBODIMENTS

The yellow dye forming couplers used in this invention have the feature that one hydrogen atom at the position involved in the coupling reaction with an oxidized primary aromatic amino color developing agent is substituted with a diacylamino group, and includes the couplers described in, for instance, Japanese Patent Application (OPI) Nos. 26,133/'73; 29,432/'73; 66,834/'73; 66,835/'73; and 73,147/'73; Japanese Patent Application No. 37,651/'74 which corresponds to U.S. Pat. No. 4,022,620; and Japanese Patent Publication 13,576/'74 which corresponds to British Pat. No. 1,331,179.

Among the yellow dye forming couplers described above, the yellow dye forming couplers represented by general formula (II) or (III) are particularly preferred for use in this invention:

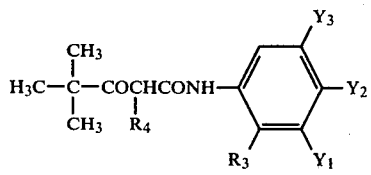

(II)

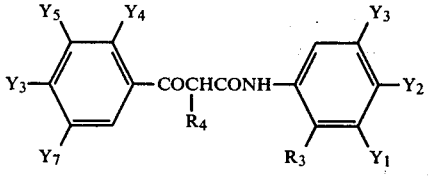

(III)

wherein $R_3$ represents a halogen atom (e.g., fluorine, chlorine, bromine, etc.), an alkyl group (e.g., a methyl group, an ethyl group, a tert-butyl group, etc.), an alkoxy group (e.g., a methoxy group, an ethoxy group, a propoxy group, an octoxy group, etc.), an aryloxy group (e.g., a phenoxy group, a methylphenoxy group, etc.) or a substituted amino group (e.g., an N,N-dimethylamino group, an N-butyl-N-octylamino group, etc.); $Y_1$, $Y_2$, and $Y_3$, which may be the same or different, each represents a hydrogen atom, a halogen atom (e.g., fluorine, chlorine, or bromine, etc.), an alkyl group (e.g., a methyl group, an ethyl group, an allyl group, an octadecyl group, etc.), an alkoxy group (e.g., a methoxy group, an ethoxy group, a dodecyloxy group, etc.), an aryl group (e.g., a phenyl group, etc.), an arylamino group (e.g., an anilino group, etc.), an acylamino group (e.g., an acetamido group, an α-(3-pentadecylphenoxy)butyramido group, etc.), an alkylsulfonamido group having 8 to 30 carbon atoms (e.g., a hexadecylsulfonamido group, etc.), an alkylaminosulfo group having 8 to 30 carbon atoms (e.g., a propylaminosulfo group, etc.) a carboxy group, a sulfo group, a cyano group or a hydroxy group; $Y_4$, $Y_5$, $Y_6$, and $Y_7$, which may be the same or different, each represents a hydrogen atom, an alkyl group (e.g., a methyl group, an ethyl group, a tert-butyl group, etc.), an alkoxy group (e.g., a methoxy group, an ethoxy group, a propoxy group, an octoxy group, etc.), an aryloxy group (e.g., a phenoxy group, a methylphenoxy group, etc.), an amino group (e.g., an amino group, an N,N-dimethylamino group, an N-butyl-N-octylamino group, etc.), an alkylsulfonamido group having 8 to 30 carbon atoms (e.g., a hexadecylsulfonamido group, etc.), an alkylaminosulfo group having 8 to 30 carbon atoms (e.g., a propylaminosulfo group, etc.), or an acylamino group (e.g., an acetamido group, an α-(2,4-di-tert-amylphenoxy)butyramido group, etc.); and $R_4$ represents a group represented by general formula (IV), (V), (VI) or (VII):

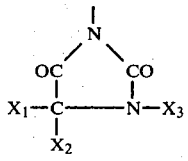

(IV)

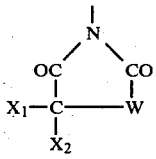

(V)

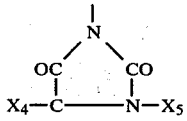

(VI)

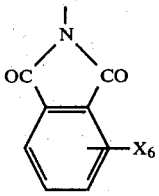

(VII)

wherein $X_1$ and $X_2$, which may be the same or different, each represents a hydrogen atom, an alkyl group, an aryl group, an alkoxy group, an aryloxy group, or a hydroxy group; $X_3$, $X_4$, and $X_5$, which may be the same or different, each represents a hydrogen atom, an alkyl group, an aryl group, or an acyl group; W represents an oxygen atom or a sulfur atom; and $X_6$ represents a hydrogen atom, a halogen atom, a nitro group, a cyano group, a thiocyano group, a hydroxy group, an alkoxy group, an aryloxy group, an acyloxy group, an alkyl group, an alkenyl group, an aryl group, an amino group, a carboxyl group, an acyl group, an alkoxycarbonyl group, an aryloxycarbonyl group, a carbamoyl group, an acylamino group, an imido group, a sulfo group, an alkylsulfonyl group, an arylsulfonyl group, an alkoxysulfonyl group, an aryloxysulfonyl group, a sulfamoyl group, a sulfonamido group, a ureido group, a thioureido group, etc.

The couplers of formula (II) or (III), in which one of $Y_1$, $Y_2$ and $Y_3$ is an alkylsulfonamido group having 8 to 30, preferably 12 to 20, carbon atoms, are especially preferred in this invention, since the maximum density of these couplers is extremely high and little variation in the maximum density occurs when the quantity of the competing coupler in a processing solution is increased. Use of these couplers is preferred since the quantity of silver used can be reduced and their use permits a large quantity of competing couplers to be employed.

The coupler of formula (II), (III) is preferably rendered non-diffusible by a group having a hydrophobic residue or "ballast group" having 8 to 32 carbon atoms in the molecule thereof. The ballast group can be bonded to the coupler directly or through a group such as an imino, ether, thioether, carbonamido, sulphonamido, ureido, ester, imido, carbamoyl or sulphamoyl group.

Specific examples of suitable ballast groups are illustrated below (all alkyl groups being linear unless otherwise indicated).

(I) Alkyl groups and alkenyl groups:

For example, $-CH_2-CH-(C_2H_5)_2$, $-C_{12}H_{25}$, $-C_{16}H_{33}$, and $-C_{18}H_{35}$.

(II) Alkoxyalkyl groups:

For example, $-(CH_2)_3-O-(CH_2)_7CH_3$ and $$-(CH_2)_3OCH_2-\underset{\underset{C_2H_5}{|}}{CH}-(CH_2)_8-CH_3.$$

as described in Japanese Patent Publication No. 27563/1964.

(III) Alkylaryl groups: For example,

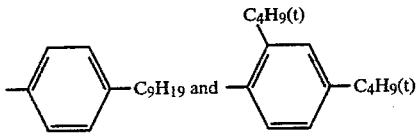

(IV) Alkylaryloxyalkyl groups: For example,

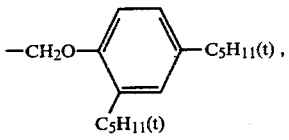

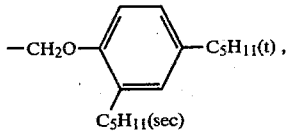

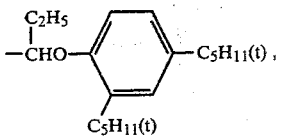

-continued

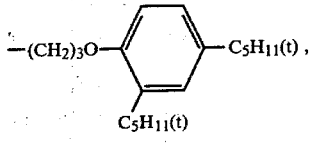

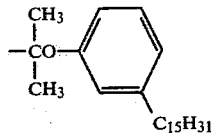

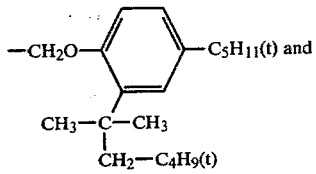

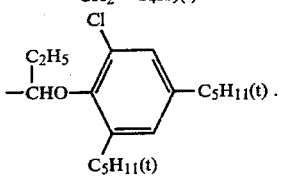

(V) Acylamidoalkyl groups: For example,

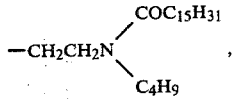

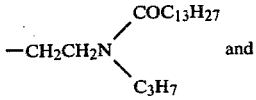

and

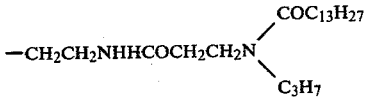

as described in U.S. Pat. Nos. 3,337,344 and 3,418,129.

(VI) Alkoxyaryl groups and aryloxyaryl groups: For example,

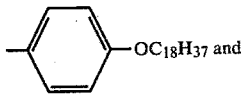

and

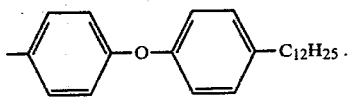

(VII) Residues each containing both an alkyl or alkenyl long-chain aliphatic group and a carboxyl or sulfo water-solubilizable group: For instance,

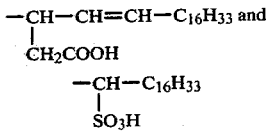

(VIII) Alkyl groups substituted with an ester group: For example, $$-\underset{\underset{COOC_2H_5}{|}}{CH}-C_{16}H_{33}\text{, and}$$
$$-CH_2CH_2-COOC_{12}H_{25}.$$
(IX) Alkyl groups substituted with an aryl group or a heterocyclic group: For example,
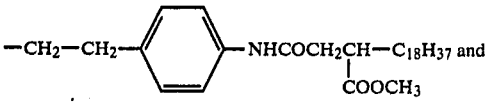
-continued
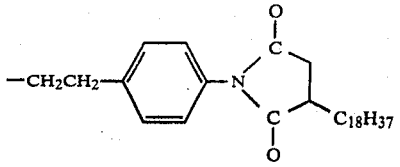
(X) Aryl groups substituted with an aryloxyalkoxycarbonyl group: For example,
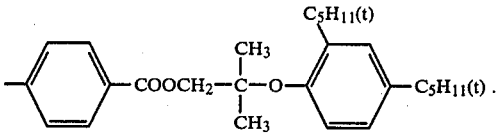
Specific examples of the yellow dye forming couplers used in this invention are illustrated below:
(1)
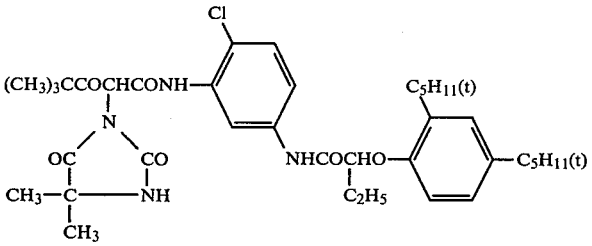
(2)
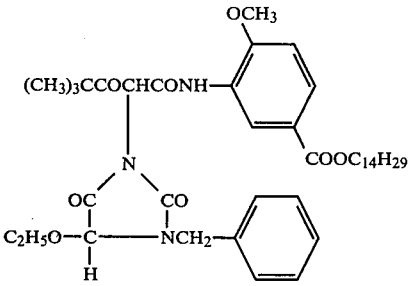
(3)
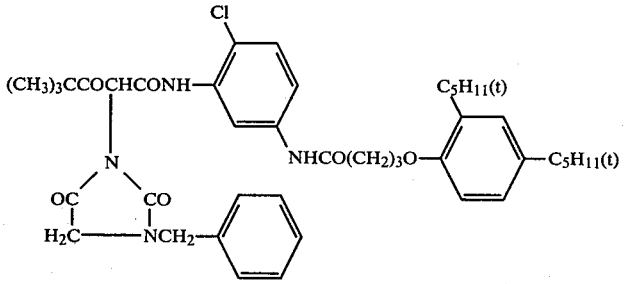
(4)
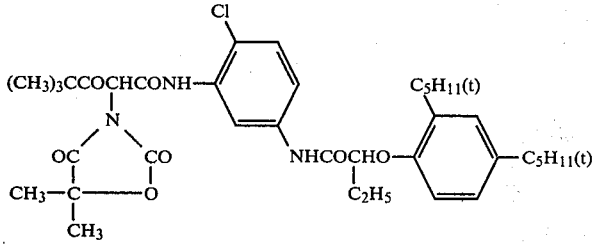

-continued
(5)
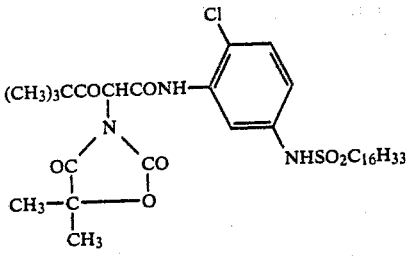
(6)
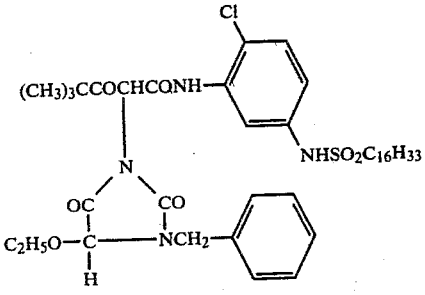
(7)
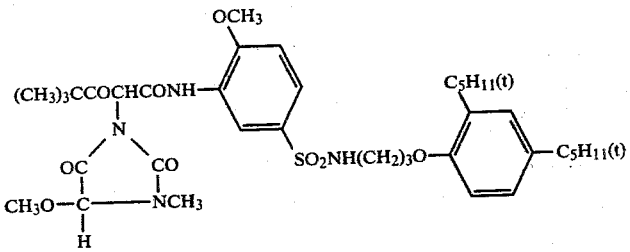
(8)
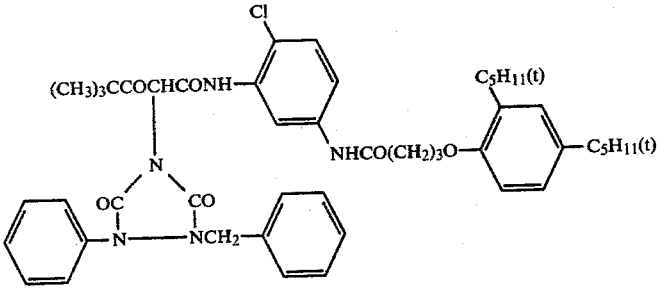
(9)
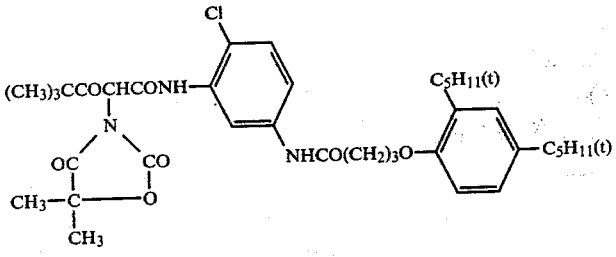
(10)
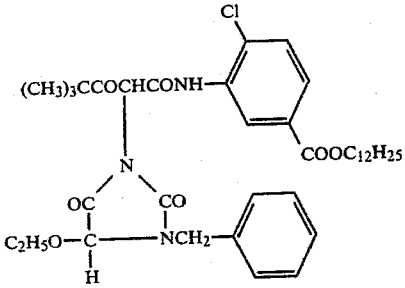

-continued
(11)
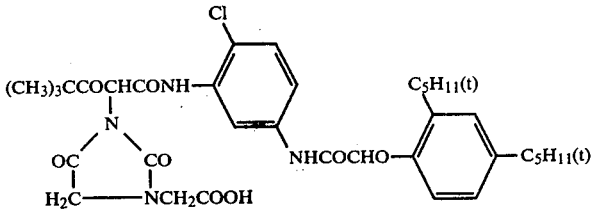
(12)
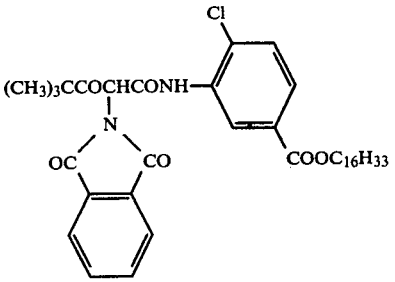
(13)
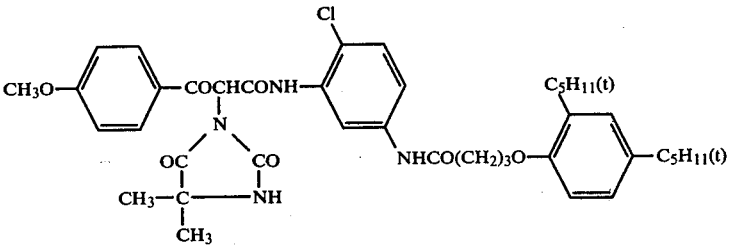
(14)
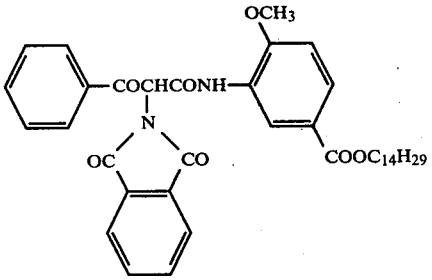
(15)
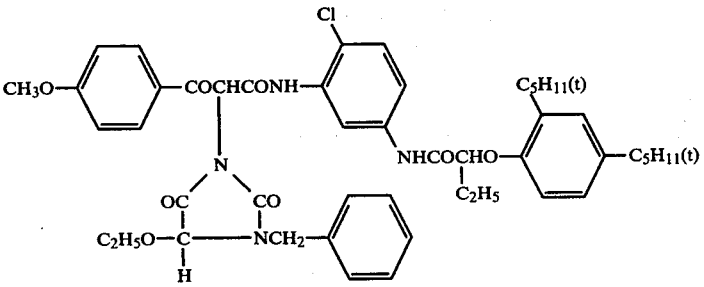
(16)
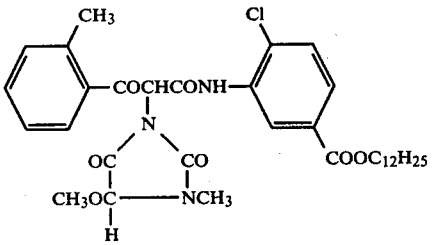

-continued (17)

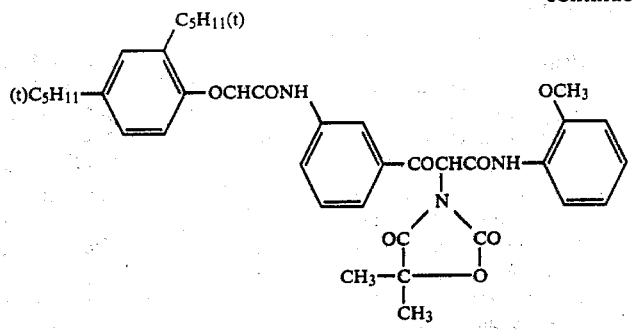

The multilayer color photographic materials of this invention can contain known color-forming couplers, in addition to the yellow dye forming couplers described above. In particular, the couplers represented by the following general formula are useful. More specifically magenta forming couplers of the general formula (A)

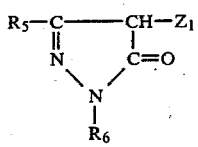

(A)

wherein $R_5$ represents a primary, secondary, or tertiary alkyl group (e.g., a methyl group, a propyl group, an n-butyl group, a tert-butyl group, a hexyl group, a 2-hydroxyethyl group, a 2-phenylethyl group, a pentadecyl group etc.), an aryl group (e.g., a phenyl group, 2,4-a di-tert-phenyl group, etc.), an alkoxy group (e.g., a methoxy group, a ethoxy group, a benzyloxy group, etc.), an aryloxy group (e.g., a phenoxy group, etc.), a heterocyclic group (e.g., a quinolinyl group, a pyridyl group, a benzofuranyl group, a oxazolyl group, etc.), an amino group (e.g., a methylamino group, a diethylamino group, a phenylamino group, a tolylamino group, a 4-(3-sulfobenzamino)-anilino group, a 2-chloro-5-acrylaminoanilino group, a 2-chloro-5-alkoxycarbonylanilino group, a 2-trifluoromethylphenylamino group, etc.), an acylamino group (e.g., an alkylcarbamido group, such as an ethylcarbamido group, an arylcarboamide group, such as phenylcarbamido group etc., a heterocyclic carbamido group such as a benzothiazolylcarboamido group, an alkyl sulfamido group such as a methyl sulfamido group, etc., or an arylsulfamido group such as a phenylsulfamido group etc.), or a ureido group (e.g., an alkylureido group, an arylureido group, a heterocyclic ureido group, etc.); $R_6$ represents an aryl group (e.g., a naphthyl group, a phenyl group, a 2,4,6-trichlorophenyl group, a 2-chloro-4,6-dimethylphenyl group, a 2,6-dichloro-4-methoxyphenyl group, a 4-methylphenyl group, a 4-acylaminophenyl group, a 4-alkylaminophenyl group, a 4-trifluoromethylphenyl group, a 3,5-dibromophenyl group, etc.), a heterocyclic group (e.g., a benzofuranyl group, a benzothiazolyl group, a quinolinyl group, etc.), or an alkyl group (e.g., a methyl group, an ethyl group, a t-butyl group, a benzyl group, etc.); $Z_1$ represents a hydrogen atom or a group which can be released at color development, such as, for example, a thiocyano group, an acyloxy group, an aryloxy group, an alkoxy group, an alkoxycarbonyloxy group, an aryloxycarbonyloxy group, a di-substituted amino group, etc., as described in U.S. Pat. Nos. 3,419,391; 3,252,924; 3,311,476; and 3,227,550 are useful.

In addition, magenta-forming couplers described in U.S. Pat. Nos. 3,600,788, 3,062,653, 3,061,432, 3,935,015 and 3,684,514 can be employed.

Specific examples of magenta-forming couplers include the following:

1-(2,4,6-Trichlorophenyl)-3-[3-(2,4-di-tert-amylphenoxyacetamido)benzamidol]-5-pyrazolone 1-(2,4,6-Trichlorophenyl)-3-[3-(2,4-di-tert-amylphenoxyacetamido)benzamido]-4-acetoxy-5-pyrazolone 1-(2,4,6-Trichlorophenyl)-3-tetradecanamido-4-(4-hydroxyphenylazo)-5-pyrazolone 1-(2,4,6-Trichlorophenyl)-3-[(2-chloro-5-tetradecanamido)anilino]-5-pyrazolone 1-(2,4-Di-chloro-6-methoxyphenyl)-3-[(2-chloro-5-tetradecanoylamino)anilino]-4-benzyloxycarbonyloxy-5-pyrazolone 1-(2,4,6-Trichlorophenyl)-3-[3-(2,4-di-tert-amylphenoxyacetamido)benzamido]-4-piperidino-5-pyrazolone 1-(2,4,6-Trichlorophenyl)-3-[2-chloro-5-α(or γ)-2,4-di-tert-amylphenoxy)butyramido]anilino-4-N-phthalimido-5-pyrazolone Cyan forming couplers of the general formulas (B) and (C)

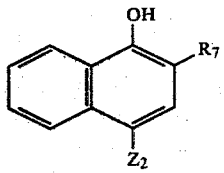

(B)

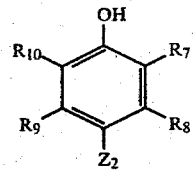

(C)

wherein $R_7$ represents a substituent usually used for cyan couplers, such as a carbamyl group (e.g., an alkylcarbamyl group such as a methyl carbamyl group, an arylcarbamyl group such as a phenylcarbamyl group etc., a heterocyclic carbamyl group such as a benzothiazolylcarbamyl group, etc.), a sulfamyl group (e.g, an alkylsulfamyl group, an arylsulfamyl group such as a phenylsulfamyl group, a heterocyclic sulfamyl group, etc.), an alkoxycarbonyl group, an aryloxycarbonyl group, etc.; $R_8$ represents an alkyl group, an aryl group, a heterocyclic group, an amino group, a carbamido group (e.g., an alkylcarbamido group, an arylcarbamido group a heterocyclic carbamido group, etc.), a sulfamido group, a sulfamyl group, or a carbamyl group; $R_8$, $R_9$ and $R_{10}$ each represents a group as defined for $R_7$ or further represents a halogen atom or an alkoxy group; and $Z_2$ represents a hydrogen atom or a group which can be released at color development, such as, for example, a halogen atom, a thiocyano group, a cycloimido group (e.g., maleimido group, succinimido group, 1,2-dicarboxyimido group, etc.), an arylazo group, or a heterocyclic azo group can be used.

Suitable cyan-forming couplers which can be used in the present invention are described in, for example, U.S. Pat. Nos. 2,895,826, 2,474,293, 2,698,749 and 3,591,383, W. German Patent Application (OLS) No. 2,502,820 and Japanese Patent Publication No. 5547/74.

Specific examples of cyan-forming couplers include the following

1-Hydroxy-N-[ω-(2,4-di-tert-amylphenoxy)propyl]-2-naphthamide

1-Hydroxy-4-chloro-N-[ω-(2,4-di-tert-amylphenoxy)-butyl]-2-naphthamide

5-Methyl-4,6-dichloro-2-[α-(3-n-pentadecylphenoxy)-butyramido]phenol

5-[α-(2,4-Di-tert-amylphenoxy)butyramido]-2-heptafluorobutyramidophenol

2-[α-(2,4-di-tert-amylphenoxy)butyramido]-4,6-dichloro-5-methylphenol

As a yellow forming coupler, an open-chain ketomethylene type coupler as is known in the art can be used with the yellow dye forming couplers of the present invention described above. Of those, benzoylacetanilide type compounds and pivaloylacetanilide type compounds are preferred. Examples of yellow-forming couplers which can be used in the present invention are described in, for example, U.S. Pat. Nos. 2,875,057, 3,265,506, 3,408,194, 3,551,155, 3,582,322, 3,725,072 and 3,891,445, W. German Pat. No. 1,547,868, W. German Patent applications (OLS) Nos. 2,213,461, 2,219,917, 2,261,361, 2,263,875 and 2,414,006.

The multilayer colour photographic materials used in this invention preferably contain a development inhibitor releasing coupler (i.e., a DIR coupler) as described in, e.g., German Pat. (OLS) No. 2,414,006 and U.S. Pat. No. 3,227,554 in addition to the yellow dye forming couplers described above since in this case photographic materials having quite excellent granularity color reproduction, and sharpness can be obtained. Furthermore, hydroquinones known as development inhibitor releasing hydroquinones (i.e., DIR hydroquinones) as described in German Pat. (OLS) No. 2,417,914 and U.S. Pat. No. 3,379,529 provide almost the same effect as the DIR coupler.

The multilayer photographic light-sensitive materials of the present invention can be conventional photographic light-sensitive materials containing silver halide as a light-sensitive materials containing silver halide as a light-sensitive material.

The silver halide photographic emulsion which can be used in the present invention comprises a light-sensitive silver halide such as silver chloride, silver bromide, silver chlorobromide, silver iodobromide, silver chloroiodide, silver chloroiodobromide, and the like, dispersed in a hydrophilic polymer, and can be prepared by various known methods. For example, a single jet method, a double jet method, a controlled double jet method, and the like, can be employed. A mixture of two or more silver halide emulsions which are prepared separately can also be used.

The silver halide grains can have a homogeneous crystal structure, layered structure in which the interior differs from the outer layer of the grain, or the so-called conversion-type silver halide grains as described in British Pat. No. 635,841 and U.S. Pat. Nos. 2,592,250 and 3,622,318. Silver halide grains which form latent image predominantly on the surface of the grains or predominantly in the interior of the grains can also be used. These photographic emulsions are described, for example, in C. E. K. Mees & T. H. James, *The Theory of the Photographic Process,* 3rd Ed., MacMillan, New York (1966); and P. Glafkides, *Chimie Photographique,* Paul Montel, Paris, (1957), and can be prepared by known methods such as an ammonia method, a neutral method and an acid method.

After the formation of the silver halide grains, the emulsion can be washed with water in order to remove the by-produced water-soluble salts (for example, potassium nitrate where silver bromide is formed from silver nitrate and potassium bromide), and then ripened by heating in the presence of a chemical sensitizer such as sodium thiosulfate, N,N,N'-trimethylthiourea, a thiocyanate complex of monovalent gold, a thiosulfate complex of monovalent gold, stannous chloride, hexamethylenetetramine, and the like, to increase the sensitivity without coarsening the grains. General methods for these chemical sensitization techniques are described in the above-mentioned references.

Specific examples of suitable chemical sensitizers include, for example, gold compounds such as chloroaurates and gold trichloride as described in U.S. Pat. Nos. 2,399,083, 2,540,085, 2,597,856 and 2,597,915; salts of a noble metal, such as platinum, palladium, iridium, rhodium and ruthenium, as described in U.S. Pat. Nos. 2,448,060, 2,540,086, 2,566,245, 2,566,263 and 2,598,079; sulfur compounds capable of forming silver sulfide by reacting with a silver salt, such as those described in U.S. Pat. Nos. 1,574,944, 2,410,689, 3,189,458 and 3,501,313; stannous salts, amines, and other reducing compounds such as those described in U.S. Pat. Nos. 2,487,850, 2,518,698, 2,521,925, 2,521,926, 2,694,637, 2,983,610 and 3,201,254, and the like.

The photographic emulsions can be spectrally sensitized or supersensitized using a cyanine dye such as cyanine, merocyanine, carbocyanine or styryl dyes, either individually or in combination. Spectral sensitization techniques are well known, and are described, for example, in U.S. Pat. Nos. 2,493,748, 2,519,001, 2,977,229, 3,480,434, 3,672,897, 3,703,377, 2,688,545, 2,912,329, 3,397,060, 3,615,635 and 3,682,964; British Pat. Nos. 1,195,302, 1,242,588 and 1,293,862; German patent application OLS Nos. 2,030,326 and 2,121,780; Japanese patent publication Nos. 4,936/1968, 1,4030/1969 and 10,773/1968; U.S. Pat. Nos. 3,511,664, 3,522,052, 3,527,641, 3,615,613, 3,615,632, 3,617,295, 3,635,271 and 3,694,217; and British Pat. Nos. 1,137,580 and 1,216,203, and the like. The spectral sensitizers can be chosen as desired depending on the spectral range, sensitivity, and the like depending on the purpose and users of the photographic materials to be sensitized.

Various kinds of conventional stabilizers or anti-fogging agents can be added to the photographic emulsions used in the present invention in order to prevent a reduction in the sensitivity or a formation of fog. A wide variety of such compounds are known such as heterocyclic compounds, mercury-containing compounds, mercapto compounds or metal salts, including 4-hydroxy-6-methyl-1,3,3a,7-tetraazaindene, 3-methylbenzothiazole and 1-phenyl-5-mercaptotetrazole. Examples of these compounds which can be used are described, for example, in U.S. Pat. Nos. 1,758,576, 2,110,178, 2,131,038, 2,173,628, 2,697,040, 2,304,962, 2,324,123, 2,394,198, 2,444,605-8, 2,566,245, 2,694,716, 2,697,099, 2,708,162, 2,728,663-5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,622,339; and British Pat. Nos. 893,428, 403,789, 1,173,609 and 1,200,188.

Examples of hydrophilic colloids which can be used as a binder for the silver halide grains include, for example, gelatin, colloidal albumin, casein, a cellulose derivative such as carboxymethylcellulose and hydroxyethylcellulose, a polysaccharide derivative such as agar-agar, sodium alginate and a starch derivative, a synthetic hydrophilic colloid such as polyvinyl alcohol, poly-N-vinyl pyrrolidone, polyacrylic acid copolymers and polyacrylamide, or the derivatives or partially hydrolyzed products thereof. If desired, compatible mixtures of these colloids can also be employed. Of these colloids, gelatin is most commonly used. It can be replaced partially or completely by a synthetic polymer, by a so-called gelatin derivative such as those prepared by reacting or modifying the amino, imino, hydroxy or carboxy groups contained, as functional groups, in the gelatin molecule with a compound containing a group capable of reacting with the above-described groups, or a graft gelatin such as those prepared by grafting another polymer chain on the gelatin molecule.

Examples of suitable compounds which can be used for the preparation of the above-described gelatin derivatives include isocyanates, acid chlorides and acid anhydrides such as those described in U.S. Pat. No. 2,614,928; acid anhydrides such as those described in U.S. Pat. No. 3,118,766; bromoacetic acids such as those described in Japanese patent publication No. 5,514/1964; phenyl glycidyl ethers such as those described in Japanese patent publication No. 26,845/1967; vinylsulfones such as those described in U.S. Pat. No. 3,132,945; N-allylvinylsulfonamides such as those described in British Pat. No. 861,414; maleinimides such as those described in U.S. Pat. No. 3,186,846; acrylonitriles such as those described in U.S. Pat. No. 2,594,293, polyalkylene oxides such as those described in U.S. Pat. No. 3,312,553, epoxy compounds such as those described in Japanese patent publication No. 26,845/1967; ester such as those described in U.S. Pat. No. 2,763,639; and alkane sultones such as those described in British Pat. No. 1,033,189.

A wide variety of polymers or copolymers can be employed as polymers to be grafted to gelatin including those obtained from the so-called vinyl monomers such as acrylic acid, methacrylic acid or derivatives thereof, e.g., the esters, amides and nitriles thereof; or styrene. Other examples of suitable polymers are described in U.S. Pat. Nos. 2,763,625, 2,831,767 and 2,956,884; *Polymer Letters*, Vol. 5, page 595 (1967); *Photo. Sci. Eng.*, Vol. 9, page 148 (1965); and *J. Polymer Sci.*, Part A-1, Vol. 9, page 3, 199 (1971). Hydrophilic polymers or copolymers having a certain degree of compatibility with gelatin such as those prepared from acrylic acid, methacrylic acid, acrylamide, methacrylamide, hydroxyalkylacrylates, hydroxyalkylmethacrylates, and the like are particularly desirable.

The hydrophilic layers which constitute the photographic light-sensitive materials in the present invention can be hardened using conventional methods. Examples of suitable hardeners include, for example, an aldehyde type compound such as formaldehyde and glutaraldehyde; a ketone compound such as diacetyl and cyclopentadione; a reactive halogen-containing compound such as bis(2-chloroethylurea), 2-hydroxy-4,6-dichloro-1,3,5-triazine and those described in U.S. Pat. Nos. 3,288,775 and 2,732,303; and British Pat. Nos. 974,723 and 1,167,207; a reactive olefin containing compound such as divinyl sulfone, 5-acetyl-1,3-diacryloylhexahydro-1,3,5-triazine and those described in U.S. Pat. Nos. 3,635,718 and 3,232,763; and British Pat. No. 994,869; an N-methylol compound such as N-hydroxymethylphthalimide and those described in U.S. Pat. Nos. 2,732,316 and 2,586,168; an isocyanate compound such as those described in U.S. Pat. No. 3,103,473; and aziridine compound such as those described in U.S. Pat. Nos. 3,017,280 and 2,983,611; and acid derivative such as those described in U.S. Pat. Nos. 2,725,294 and 2,725,295; a carbodiimide compound such as those described in U.S. Pat. No. 3,100,704; an epoxy compound such as those described in U.S. Pat. No. 3,091,537; an isooxazole compound such as those described in U.S. Pat. Nos. 3,321,313 and 3,543,292; a halocarboxyaldehyde such as mucochloric acid; a dioxane derivative such as dihydroxydioxane and dichlorodioxane; and an inorganic hardener such as chrome alum and zirconium sulfate. Instead of the above compounds, precursors of hardeners such as the alkali metal bisulfite-aldehyde adducts, methylol derivatives of hydantoin, primary fatty nitroalcohols and the like can also be used.

The photographic layers which constitute the photographic light-sensitive materials of the present invention can be applied to a substantially planar material such does not undergo any servere dimensional change during processing, for example, a rigid support such as glass, metal or ceramics, or a flexible support as desired. Representative flexible supports include those generally employed for photographic materials, such as a cellulose nitrate film, a cellulose acetate film, a cellulose acetate butyrate film, a cellulose acetate propionate film, a polystyrene film, a polyethylene terephthalate film, a polycarbonate film, a laminate of these polymers, a thin glass film and paper. A baryta coated paper, a paper which is coated or laminated with an α-olefin polymer, particularly those obtained from a monomer having from 2 to 10 carbon atoms, such as polyethylene, polypropylene and ethylene-butene copolymers, and a synthetic resin film in which the adhesiveness to other polymers and the printing properties are improved by roughening the surfaces thereof, such as is described in Japanese patent publication No. 19,068/1972 can also be used to advantage as a support.

These supports can be transparent or opaque, depending on the purposes of the photographic materials. Colored transparent supports which contain a dye or pigment can also be used. Such colored supports have been utilized in X-ray films, and are described in *J. SMPTE*, Vol. 67, page 296 (1958).

Examples of opaque supports include opaque films produced by incorporating into a transparent film a dye or a pigment such as titanium oxide and zinc oxide, a surface-treated plastic films such as those described in Japanese patent publication No. 19,068/1972, as well as intrinsically opaque materials such as paper. Highly light-shielding papers and synthetic resin films containing, for example, carbon black or dyes can also be used. When the adhesion between a support and a photographic layer is unsatisfactory, a subbing layer adhesive to both the support and the photographic layer can be provided on the support. The surfaces of the support can also be pre-treated by a corona discharge, a UV radiation treatment, a flame treatment and the like in order to further improve the adhesion.

The photographic layers can be applied to a support using various conventional coating methods, including, for example, a dip coating method, an air-knife coating method, a curtain coating method and an extrusion coating method using the hopper described in U.S. Pat. No. 2,681,294. If desired, two or more layers can be coated simultaneously using the methods as described in U.S. Pat. Nos. 2,761,791, 3,508,947, 2,941,898 and 3,526,528.

The color couplers generally can be used in an amount of about $10^{-6}$ to about $10^{-3}$ mol/m$^2$ in each layer.

The photographic light-sensitive materials of the present invention can include in addition to the silver halide emulsion layers, substantially light-insensitive layers including conventional layers such as a surface protective layer, a filter layer, an intermediate layer, an antihalation layer, a barrier layer, an anti-curling layer, a backing layer, and the like.

The color photographic materials in this invention can also contain a hydroquinone derivative such as an alkylhydroquinone as a color mixing prevention agent. Such a hydroquinone derivative is advantageous by incorporated in the interlayers. In particular, hydroquinone derivatives as disclosed in U.S. Pat. Nos. 2,360,290, 2,336,327, 2,403,721, 2,418,613, 2,675,314 and 2,701,197, are particularly preferred.

In the multilayer color photographic materials of this invention, the coating amount of silver in each of the green-sensitive emulsion layer and the red-sensitive emulsion layer is preferably about 0.5 to about 3 g/m$^2$, more preferably, 1 to 2 g/m$^2$ and the coating amount of silver in the blue-sensitive emulsion layer is preferably about 0.2 to about 2 g/m$^2$, more preferably, 0.5 to 1.5 g/m$^2$.

The competing coupler(s) used in this invention are compounds which undergo a coupling reaction with an oxidized primary aromatic amino color developing agent to form a substantially colorless compound or form a compound permeating or diffusing away from the emulsion layer into a processing solution and not substantially remaining in the emulsion layer (e.g., substantially no dye density is observed). Any compound having the above-mentioned properties can be used in this invention and examples of such competing couplers are described in U.S. Pat. Nos. 2,689,793; 2,742,832; 3,520,690; 3,560,212; 3,645,737; and 3,714,862; British Pat. No. 1,204,964; and Japanese patent publications 9505/'69; 9506/'69 and 9507/'69. Specific examples of useful competing couplers are citrazinic acid, 3,5-dihydroxybenzoic acid, methyl 2,6-dihydroxyisonicotinate, 2,6-dihydroxyisonicotinamide, methyl 3,5-dihydroxybenzoate, and the like. When the competing coupler is used in a color developing solution the amount of the competing coupler can suitably range from about $3\times10^{-3}$ to $3\times10^{-2}$ mol/liter, preferably $5\times10^{-3}$ to $1.5\times10^{-2}$ mol/liter.

In the present invention, any photographic processing known in the art can be utilized. For instance, conventional black and white developing processings and color developing processings can be utilized in the present invention. In general, the processing temperature can range from about 18° C. to 50° C., but may be lower than 18° C. or higher than 50° C., as desired.

For black and white development, a conventional developing agent can be used. Examples of suitable developing agents include dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid and the like. These developing agents can be used alone or as a combination thereof.

In general, a black and white developing solution contains, in addition to the developing agents described above, a preservative, an alkaline agent, a pH buffer, an anti-fogging agent, etc., and if desired, may further contain a dissolving aid, a toning agent, a development accelerator, a surface active agent, an antifoaming agent, an water softener, a hardening agent, an agent for increasing viscosity, etc., each of which is well known in the art.

In the present invention, conventional fixing solution containing a fixing agent such as a thiosulfate, a thiocyanate, an organic sulfur compound functioning as a fixing agent can be used. Further the fixing solution may contain water-soluble aluminum salts as a hardening agent.

For forming a dye image, conventional processings can be employed, for example, a negative-positive printing process as described in *Journal of the Society of Motion Picture and Television Engineers,* Vol. 61, pp. 667–701 (1953), a color reversal process wherein a negative silver image is formed upon development using a developing solution containing a black and white developing agent, following by at least one uniform exposure, alternatively by any other appropriate fogging treatment, subsequently being conducted to color development thereby to form a dye positive image, a silver dye bleaching process wherein a photographic emulsion containing dyes is developed to form a silver image after exposure, the thus obtain silver image functioning as a catalyst for bleaching the dyes, and the like can be utilized.

A color developing solution, in general, comprises an alkaline aqueous solution containing a color developing agent. The color developing agents which can be used in the present invention are conventional primary aromatic amino developing agents which have the function of developing exposed silver halide and forming a dye by reaction of the oxidation product with a coupler such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl(-N-$\beta$-hydroxyethylanilino, 3-methyl-4-amino-N-ethyl-N-$\beta$-methanesulfoamidoethylaniline, 4-amino-3-methyl-N-ethyl-N-$\beta$-methoxyethylaniline, etc. In addition, compounds as disclosed in L.F.A. Mason *Photographic Processing Chemistry,* pp. 226–229 Focal Press (1966), U.S. Pat. Nos. 2,193,015 and 2,592,364 and Japanese patent application (OPI) No. 64933/73 can also be used. A suitable amount of the developing agent which can be present can range from about $10^{-3}$ to $10^{-1}$ mol/liter.

The color developing solution can further contain a pH buffer such as the sulfites, carbonates, borates and phosphates of alkali metals, a development inhibitor (and anti-fogging agent) such as a bromide, an iodide, and an organic anti-fogging agent. The color developing solution can further contain a water softener, a preservative such hydroxylamine, an organic solvent such as benzyl alcohol, diethylene glycol, a development accelerator such as polyethylene glycol, quaternary ammonium salts, amines, a color-forming coupler, a competing coupler, a fogging agent such as sodium borohydride, a developing aid such as 1-phenyl-3-pyrazolidone, and agent for increasing viscosity, and the like, if desired.

After color development, the photographic material is generally subjected to bleaching. The bleaching treatment may be carried out separately from or with fixation simultaneously. Suitable bleaching agents include polyvalent metal compounds such as iron (III), cobalt (III), chromium (VI), copper (II), etc., peroxides, quinones, nitroso compounds and the like. For example, ferricyanides, dichromates, organic complex salts of iron (III) or cobalt (III), amino polycarboxylic acids such as ethylenediamine tetraacetic acids, nitrilotriacetic acids, 1,3-diamino-2-propanol tetraacetic acid or complex salts of organic acids such as citric acid, tartaric acid, malic acid, etc., persulfates, permanganates, nitrosophenol and the like can be used. Of these, potassium ferricyanide, sodium iron (III) ethylenediamine tetraacetate and ammonium iron (III) ethylenediamine tetraacetate are particularly preferred. Further, iron (III) complex of ethylenediamine tetraacetic acid can be used either in a bleaching solution or blixing solution. The bleaching or blixing solution, further, can contain, if desired, a bleaching accelarator as disclosed in U.S. Pat. Nos. 3,042,520, 3,241,966 and Japanese patent publications Nos. 8506/70 and 8836/70, and other conventional additives.

The invention will now be illustrated in more detail by the following examples. Unless otherwise indicated, all parts, percents, ratios, and the like are by weight.

EXAMPLE 1

Sample A was prepared by coating on a cellulose triacetate support having a subbing layer the following silver halide emulsion layers and auxiliary layers in the recited order.

First Layer: Red-sensitive emulsion layer

Into 100 ml of ethyl acetate and 100 ml of dibutyl phthalate was dissolved 100 g of a cyan coupler, 1-hydroxy-2-[γ-(2,4-di-t-amylphenoxy)butyl]naphthamide and the solution was mixed with 1 kg of an aqueous 10% gelatin solution with stirring at high speed. 350 g of the coupler dispersion thus obtained was mixed with 1 kg of a red-sensitive silver iodobromide emulsion (containing 50 g of silver and 60 g of gelatin, having an iodide content of 6 mole percent and containing 0.0050 g/m$^2$ of sensitizing dye (I) and 0.003 g/m$^2$ of sensitizing dye (II), and the resultant mixture was coated on the support at a dry thickness of 3 microns and dried.

Second Layer: Interlayer

A dispersion was prepared in the same way as in the case of the coupler dispersion for preparing the coating composition for the 1st layer except that 2,5-di-t-amylhydorquinone was used in place of the cyan coupler. 100 g of the dispersion thus prepared was mixed with 1 kg of an aqueous 5% gelatin solution, and the resultant mixture was coated at a dry thickness of 1 micron and dried.

Third Layer: Green-sensitive emulsion layer

Into 100 ml of tricresyl phosphate and 100 ml of ethyl acetate was dissolved 100 g of a magenta coupler, 1-(2,4,6-trichlorophenyl)-3-[3-(2,4-di-t-amylphenoxyacetamido)benzamido]-5-pyrazolone. The thus obtained solution was mixed with 1 kg of an aqueous 10% gelatin solution with stirring at high spped. 560 g of the coupler dispersion thus prepared was mixed with 1 kg of a green-sensitive silver iodobromide emulsion (containing 50 g of silver and 60 g of gelatin, having an iodide content of 7 mole percent and containing 0.0070 g/m$^2$ of sensitizing dye (III) and 0.0004 g/m$^2$ of sensitizing dye (IV), and the resultant mixture was coated at a dry thickness of 4.5 microns and dried.

Fourth Layer: Yellow filter layer

An emulsion containing yellow colloidal silver was coated at a dry thickness of 1 micron and dried.

Fifth Layer: Blue-sensitive emulsion layer

An emulsion was prepared by the same way as in the case of preparing the coupler dispersion for preparing the coating composition for the first layer except that a yellow coupler, α-(4-methoxybenzoyl)-2-chloro-5-[α-(2,4-di-t-amylphenoxy)butyramido]acetanilide, was used in place of the cyan coupler, 940 g of the coupler dispersion thus prepared was mixed with 1 kg of a blue-sensitive silver iodobromide emulsion (containing 60 g of silver and 60 g of gelatin and having an iodide content of 5 mole percent), and the resultant mixture was coated at a dry thickness of 3.5 microns and dried.

Sixth Layer: Protective layer

An aqueous 5% gelatin solution was coated at a dry thickness of 1 micron and dried.

Sensitizing Dye (I): Anhydro-3-(3-sulfobutyl)-3′-ethyl-5,5′-dichloro-9-ethylthiacarbocyanine hydroxide Sensitizing Dye (II): Anhydro-9-ethyl-3,3′-di-(3,sulfopropyl)-4,5,4′,5′-dibenzothiacarbocyanine hydroxide, sodium salt Sensitizing Dye (III): Anhydro-9-ethyl-3,3′-di-(3-sulfopropyl)-5,5′-diphenyl oxacarbocyanine hydroxide, sodium salt Sensitizing Dye (IV): Anhydro-5,5′,6,6′-tetrachloro-1,1′-diethyl-3,3′-di-(3-sulfopropyl)benzimidazolocarbocyanine hydroxide, sodium salt Sample B was then prepared in the same way as in the case of preparing Sample A except that 1380 g of an coupler dispersion containing a yellow coupler, α-pivaloyl-[4-(4-benzyloxyphenylsulfonyl)phenoxy]-2-chloro-5[α(3-pentadecylphenoxy)butyramido]acetanilide, was used in place of the coupler dispersion in the fifth layer.

Further Sample C was prepared in the same way as in the case of preparing Sample A except that 1060 g of a coupler dispersion containing coupler (4) of this invention was used in place of the coupler dispersion in the fifth layer.

Each of the sample films was exposed, 20 CMS, to a white light source through a step wedge and processed by the following color reversal process.

| Processing Step | Time |
|---|---|
| Prehardening | 2 min. 30 sec. |
| Neutralization | 30 sec. |
| First Development | 3 min. |
| First Stop | 30 sec. |
| Water Wash | 1 min. |
| Color Development | 3 min. 30 sec. |
| Second Stop | 30 sec. |
| Water Wash | 1 min. |
| Bleach | 2 min. |
| Fix | 1 min. |

-continued

| Processing Step | Time |
|---|---|
| Water Wash | 1 min. |

All processings were performed at a temperature of 37° C. The compositions of the processing solutions used in the above process were as follows.

| | |
|---|---|
| Prehardening Solution | |
| Formaldehyde (37% aqueous solution) | 20 ml |
| Pyruvic Aldehyde (40%) | 20 ml |
| Sulfuric Acid | 2 ml |
| Sodium Sulfate | 100 g |
| Potassium Bromide | 2 g |
| Boric Acid | 5 g |
| Water to make | 1 liter |
| Neutralizing Solution | |
| Potassium Bromide | 20 g |
| Acetic Acid (glacial) | 10 ml |
| Sodium Sulfate | 50 g |
| Sodium Hydroxide | 6 g |
| Glycine | 10 g |
| Water to make | 1 liter |
| First Developer (black and white) | |
| Sodium Hexametaphosphate | 1.0 g |
| 1-Phenyl-3-pyrazolidone | 0.3 g |
| Sodium Sulfite | 50.0 g |
| Hydroquinone | 6.0 g |
| Sodium Carbonate (monohydrate) | 35.0 g |
| Potassium Bromide | 2.0 g |
| Potassium Thiocyanate | 1.0 g |
| Potassium Iodide (0.1% aqueous solution) | 10.0 ml |
| Water to make | 1 liter |
| First and Second Stop Solution | |
| Acetic Acid (glacial) | 25 ml |
| Sodium Acetate | 3 g |
| Water to make | 1 liter |
| Color Developer | |
| Sodium Hexametaphosphate | 1.0 g |
| Benzyl Alcohol | 6.0 ml |
| Sodium Sulfite | 5.0 g |
| Sodium Tertiary Phosphate | 40.0 g |
| Potassium Bromide | 0.2 g |
| Potassium Iodide (0.1% aqueous solution) | 10.0 ml |
| Sodium Hydroxide | 6.5 g |
| 4-Amino-3-methyl-N-ethyl-N-methansulfonamidoethylaniline sulfate | 10.0 g |
| Ethylenediamine | 8.0 ml |
| Citrazinic Acid | 1.2 g |
| Sodium Borohydride | 0.1 g |
| Water to make | 1 liter |
| Bleach Solution | |
| Ferric Chloride (hexahydrate) | 200 g |
| Sodium Citrate (dihydrate) | 40 g |
| Potassium Hexacyanoferrate | 100 g |
| Sodium Acetate | 40 g |
| Potassium Bromide | 30 g |
| Water to make | 1 liter |
| Fix Solution | |
| Sodium Thiosulfate | 150 g |
| Sodium Acetate | 70 g |
| Sodium Sulfite | 10 g |
| Potassium Alum | 20 g |
| Water to make | 1 liter |

The color densities of the color images formed in each sample were measured using a blue filter, a green filter, and a red filter.

As the result, it was confirmed that in Samples A and B the gradation using a blue filter was lower than in the case of using green filter and a red filter, and the color images formed in these samples were bluish, while with Sample C processed in this invention the gradations of the three colors of the color images were balanced and the color images formed were gray due to the desirable gradation balance.

EXAMPLE 2

A reversal multi-layer color light sensitive material was prepared by coating, in succession, a first through eighth layers having the following compositions onto a transparent cellulose triacetate film base.

First Layer: Anti-halation layer

To 1 kg of a 5% aqueous geltain solution containing black colloidal silver, 25 ml of a 4% aqueous solution of 2,6-dichloro-4-hydroxy-s-triazine sodium salt (Hardening Agent 1) was added as a hardening agent. The thus obtained coating solution was coated in a dry thickness of 1.0 micron.

Second Layer: Intermediate layer 50 g of 2,5-di-t-octylhydroquinone was dissolved by adding thereto 100 ml of tricresyl phosphate and 200 ml of ethyl acetate. The solution was added to 1.0 l of an aqueous solution containing 100 g of gelatin and 5.0 g of Aerosol DT (tradename, made by American Cyanamid Corp.). The mixture was mechanically stirred vigorously with a high speed stirrer to disperse and emulsify the mixture. 250 g of the resulting emulsion (Emulsion 1) was mixed with 1.0 l of an aqueous solution containing 100 g of gelatin. To the mixture 25 ml of a 4% aqueous solution of Hardening Agent 1 was added. The thus obtained coating solution was coated in a dry thickness of 1.5 microns.

Third Layer: Red sensitive emulsion layer

The following coating solution was coated in an amount of 1.40 g/m$^2$ calculated as Ag.

To 1.0 kg of a silver iodobromide emulsion for reversal photography (containing 0.50 mol Ag, 7 mol % iodine and 60 g of gelatin), $5\times10^{-5}$ mol anhydro-5,5'-dichloro-3,3'-disulfopropyl-9-ethylthiacarbocyanine hydroxide pyridinium salt per mol of Ag and $1.2\times10^{-5}$ mol of anhydro-9-ethyl-3,3'-di(3-sulfopropyl)-4,5,4',5'-dibenzothiacarbocyanine hydroxide triethylamine salt per mol of Ag were added as red sensitive sensitizers to spectrally sensitize the emulsion. In 100 ml of dibutyl phthalate and 200 ml of ethyl acetate, 100 g of 1-hydroxy-2-[γ-(2,4-di-t-amylphenoxy)butyl]naphthamide as a cyan coupler was dissolved. In a manner similar to the preparation of Emulsion 1 in the Second Layer, Emulsion 2 was prepared using the solution obtained above. To the above described red sensitive emulsion, 530 g of Emulsion 2 was added and 20 ml of a 4% aqueous solution of Hardening Agent 1 was further added thereto. The thus obtained coating solution was coated in an amount of 1.40 g/m$^2$ calculated as Ag.

Fourth Layer: Intermediate layer

The same coating solution as in the Second Layer was coated in a dry thickness of 1.5 microns.

Fifth Layer: Green sensitive emulsion layer

To 1.0 kg of the same silver iodobromide emulsion as in the Third Layer, $2\times10^{-4}$ mol of anhydro-9'-ethyl-5,5'-dichloro-3,3'-disulfopropyloxacarbocyanine sodium salt and $6\times10^{-5}$ mol of anhydro-5,6,5',6'-tetrachloro-1,1'-diethyl-3,3'-disulfopropoxyethylimidazolocarboxyanine hydroxide sodium salt were added as green sensitive sensitizers to prepare a green sensitive emulsion. To the emulsion thus obtained was added 545 g of an emulsion obtained in a manner similar to Emulsion 1, using the soluion obtained by dissolving 100 g of 1-(2,4,6-trichlorophenyl)-3-[3-(2,4-di-t-amylphenoxyacetamido)benzamido]-5-pyrazolone as a magenta coupler in 100 ml of tricresyl phosphate and 200 ml of ethyl acetate. To the mixture, 20 ml of a 4% aqueous solution Hardening Agent 1 was further added. The thus obtained coating solution was coated in an amount of 1.75 g/m$^2$ calculated as Ag.

Sixth Layer: Yellow filter layer

To 1.0 kg of an aqueous solution containing yellow colloidal silver and 50 g of gelatin, 200 g of Emulsion 1 was added. To the mixture, 25 ml of a 4% aqueous solution of Hardening Agent 1 was further added. The thus obtained coating solution was coated in a dry thickness of 1.0 micron.

Seventh Layer: Blue sensitive emulsion layer

To 1.0 kg of a silver iodobromide emulsion for reversal photography (containing 0.50 mol of Ag, 8 mol % of iodine and 55 g of gelatin) was added 535 g of the emulsion obtained in a manner similar to Emulsion 1 using the solution obtained by dissolving 100 g of Coupler (a)

Coupler (a)

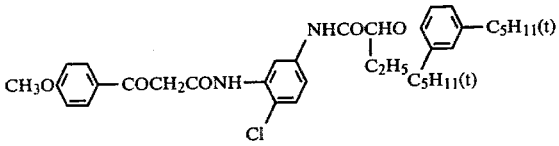

(4'-methoxybenzoyl)-2-chloro-5-[α-(2,4-di-t-amylphenoxy)butyramido]acetanilide, as a yellow coupler in 100 ml of dibutyl phthalate and 200 ml of ethyl acetate. To the mixture was further added 20 ml of a 4% aqueous solution of Hardening Agent 1. The thus obtained coating solution was coated in an amount of 2.70 g/m$^2$ calculated as Ag.

Eighth Layer: Protective layer

To 1.0 kg of an aqueous solution containing 100 g of gelatin was added 25 ml of a 4% aqueous solution of Hardening Agent 1. The thus obtained coating solution was coated in a dry thickness of 1.0 micron.

The thus obtained multi-layer color reversal light sensitive element was designated Sample D.

Then, Sample E was prepared in a manner similar to the preparation of the first to eighth layers except that Coupler (b),α-pivaloyl-α-[4-(4-benzyloxyphenylsulfonyl)phenoxy]-2-chloro-5-[γ-(2,4-di-t-amylphenoxy)-butyramido]acetanilide, was employed as the yellow coupler in the Seventh Layer and 1250 g of the emulsion obtained in the same manner as in Emulsion 1 was added and the coated amount was made 1.90 g/m$^2$ calculated as Ag to constitute the Seventh Layer.

Likewise, Sample F was prepared by employing Coupler (c), α-pivaloyl-α-(5,5'-dimethyl-2,4-dioxy-3-oxazolidinyl)-2-chloro-5-[α-(2,4-di-t-amylphenoxy)-butyramido]acetanilide, for the yellow coupler in the Seventh Layer and adding 965 g of the emulsion thereof. Sample G was prepared likewise by using Coupler (d), α-pivaloyl-α-(1-benzyl-5-ethoxy-2,4-dioxo-3-hydantoinyl)-2-chloro-5-(hexadecylsulfonamido)acetanilide, and adding 1100 g of the emulsion thereof. Finally, Sample H was prepared by using a coating amount for the Seventh Layer of 1.40 g/m$^2$ calculated as Ag.

The couplers used above had the following structures

Coupler (b)

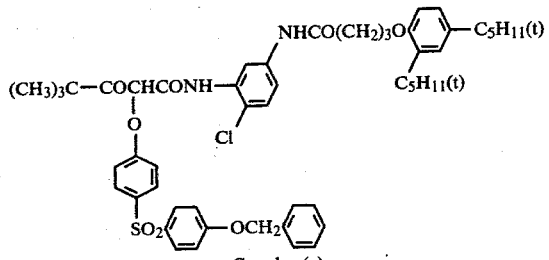

Coupler (c)

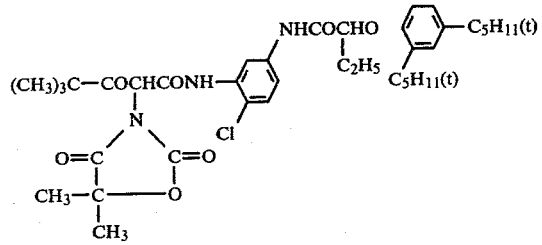

Coupler (d)

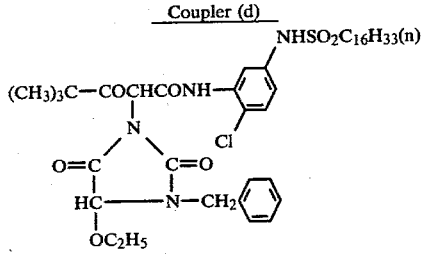

The thus obtained reversal color light sensitive elements C to G were subjected to sensitometric stepwise exposure, followed by the color reversal processing indicated below.

| Processing Step | Temperature | Time |
|---|---|---|
| Prehardening | 37° C. | 2'30" |
| Neutralization | " | 30" |
| First Development | " | 3' |
| First Stopping | " | 30" |
| Water Washing | " | 1' |
| Color Development | " | 3'30" |
| Second Stopping | " | 30" |
| Water Washing | " | 1' |
| Bleaching | " | 2' |
| Stain Removal | " | 2' |
| Fixing | " | 1' |
| Water Washing | " | 1' |

The composition of each of the processing solutions was as follows:

| | |
|---|---|
| Prehardening Solution | |
| Formaldehyde (37% aq. soln.) | 20 cc |
| Pyruvic Aldehyde (40% aq. soln.) | 20 cc |
| Sulfuric Acid | 2 cc |
| Sodium Sulfate | 100 g |
| Potassium Bromide | 2 g |
| Boric Acid | 5 g |
| Water to make | 1 l |
| Neutralizing Solution | |

-continued

| | |
|---|---|
| Potassium Bromide | 20 g |
| Acetic Acid (Glacial) | 10 cc |
| Sodium Sulfate | 50 g |
| Sodium Hydroxide | 6 g |
| Glycine | 10 g |
| Water to make | 1 l |
| First Developing Solution | |
| Sodium Hexametaphosphate | 1.0 g |
| 1-Phenyl-3-pyrazolidone | 0.3 g |
| Sodium Sulfite | 50.0 g |
| Hydroquinone | 6.0 g |
| Sodium Carbonate (monohydrate) | 35.0 g |
| Potassium Bromide | 2.0 g |
| Potassium Thiocyanate | 1.0 g |
| Potassium Iodide (0.1% aq. soln.) | 10.0 cc |
| Water to make | 1 l |
| First Stopping Solution and Second Stopping Solution | |
| Acetic Acid | 25 cc |
| Sodium Acetate | 3 g |
| Water to make | 1 l |
| Color Developing Solution | |
| Sodium Hexametaphosphate | 1.0 g |
| Benzyl Alcohol | 6.0 cc |
| Sodium Sulfite | 5.0 g |
| Sodium Triphosphate | 40.0 g |
| Potassium Bromide | 0.2 g |
| Potassium Iodide (0.1% aq. soln.) | 10.0 cc |
| Sodium Hydroxide | 6.5 g |
| 4-Amino-3-methyl-N-ethyl-N-methane-sulfonamidoethylaniline Sulfate | 10.0 g |
| Ethylenediamine | 8.0 cc |
| Citrazinic Acid | 1.2 g |
| Sodium Borohydride | 0.1 g |
| Water to make | 1 l |
| Bleaching Solution | |
| Ferric Chloride (hexahydrate) | 200 g |
| Sodium Citrate (dihydrate) | 40 g |
| Potassium Ferricyanide | 100 g |
| Sodium Acetate | 40 g |
| Acetic Acid (Glacial) | 20 ml |
| Potassium Bromide | 30 g |
| Water to make | Total 1 l |
| Fixing Solution | |
| Sodium Thiosulfate | 150 g |
| Sodium Acetate | 70 g |
| Sodium Sulfite | 10 g |
| Potassium Alum | 20 g |
| Water to make | Total 1 l |

The density of the thus obtained samples was measured using a green light filter and a red light filter, respectively.

The results obtained are shown in Table 1 below.

Table 1

| Film Sample | Coated Amount of Ag in the Seventh Layer ($g/m^2$) | Sensitivity* (relative value) | | | Gamma | | | Maximum Density | | |
|---|---|---|---|---|---|---|---|---|---|---|
| | | R | G | B | R | G | B | R | G | B |
| D | 2.70 | 100 | 100 | 100 | 4.07 | 4.16 | 3.54 | 3.15 | 3.19 | 3.05 |
| E | 1.90 | 101 | 102 | 105 | 4.05 | 4.11 | 4.13 | 3.12 | 3.14 | 3.15 |
| F | 1.90 | 101 | 102 | 107 | 4.08 | 4.15 | 4.07 | 3.15 | 3.18 | 3.06 |
| G | 1.90 | 101 | 102 | 107 | 4.04 | 4.08 | 4.47 | 3.12 | 3.15 | 3.64 |
| H | 1.40 | 101 | 103 | 107 | 4.04 | 4.07 | 4.09 | 3.10 | 3.10 | 3.13 |

*This is a relative value when Film Sample C having an exposure amount which provides a color density of 1.0 is made the standard.

Then, similar processing was performed by varying the amount of citrazinic acid present in the color developing solution to 0, 1.2, 3.5 and 10.0 g/l to measure the maximum optical density of blue light transmission in the blue sensitive emulsion layer.

The results obtained are shown in Table 2 below.

Table 2

| Film Sample | Amount of Citrazinic Acid | Maximum Optical Density of Blue Light Transmission | | | |
|---|---|---|---|---|---|
| | | 1.2 g/l | 3.5 g/l | 10.0 g/l | 0 g/l |
| D | | 3.05 | 2.50 | 1.94 | 3.48 |
| E | | 3.15 | 2.93 | 2.66 | 3.40 |
| F | | 3.06 | 2.71 | 2.37 | 3.43 |
| G | | 3.64 | 3.45 | 3.28 | 3.82 |
| H | | 3.13 | 2.97 | 2.78 | 3.29 |

From the results above it can be seen that the couplers employed in Film Samples G and H gave sufficient color density without being affected by any competitive coupler, in the color developing processing in which a competitive coupler, was present, and the proportion of density decrease which occured due to the increase in the concentration of the competitive coupler added was also small. Further, it can be seen that it was possible to reduce the amount of Ag coated and the amount of coupler coated since a high color density was obtained and therfore the possibility of improving the sharpness of the lower green sensitive emulsion layer and the red sensitive emulsion layer is suggested.

In addition, visual evaluation of the graininess of the magenta images in the green layer and the cyan images in the red layer of the samples obtained with the color developing solutions in which the amount of citrazinic acid was varied indicated that fine graininess was observed with Samples H and G.

EXAMPLE 3

In order to compare the sharpness of Samples D through H prepared as described in Example 2, the samples were exposed to white light using a test chart of a square wave pattern as an input image, followed by processing according to the processing steps described in Example 2.

A square wave response factor was measured as a response factor showing space frequency characteristics. The space frequency number was 1, 2.5, 5, 10, 15, 20, 30, 40, 50 and 60(c/mm), and the density was measured using a green filter and a red filter, respectively.

The results thereof are shown in Table 3 and Table 4, respectively. When the value is greater than a difference of 0.06, the human eye can even discern that the sharpness is improved.

Table 3

| Sample | (Square Wave Response Factor of Green Layer) Space Frequency | Response Factor | | | | | | |
|---|---|---|---|---|---|---|---|---|
| | | 1 | 2.5 | 5 | 10 | 15 | 20 | 30 |
| D | | 1.07 | 1.04 | 0.90 | 0.60 | 0.39 | 0.27 | 0.16 |

Table 3-continued

| Sample | Space Frequency | (Square Wave Response Factor of Green Layer) Response Factor 1 | 2.5 | 5 | 10 | 15 | 20 | 30 |
|---|---|---|---|---|---|---|---|---|
| E | | 1.09 | 1.11 | 1.04 | 0.76 | 0.52 | 0.34 | 0.19 |
| F | | 1.09 | 1.12 | 1.05 | 0.77 | 0.53 | 0.35 | 0.19 |
| G | | 1.09 | 1.13 | 1.06 | 0.78 | 0.53 | 0.35 | 0.19 |
| H | | 1.13 | 1.20 | 1.16 | 0.89 | 0.63 | 0.44 | 0.23 |

Table 4

| Sample | Space Frequency | (Square Wave Response Factor of Red Layer) Response Factor 1 | 2.5 | 5 | 10 | 15 | 20 | 30 |
|---|---|---|---|---|---|---|---|---|
| D | | 1.15 | 1.19 | 1.08 | 0.60 | 0.41 | 0.27 | 0.15 |
| E | | 1.19 | 1.32 | 1.24 | 0.87 | 0.60 | 0.42 | 0.21 |
| F | | 1.19 | 1.32 | 1.25 | 0.87 | 0.60 | 0.43 | 0.22 |
| G | | 1.20 | 1.33 | 1.25 | 0.88 | 0.61 | 0.43 | 0.22 |
| H | | 1.25 | 1.42 | 1.39 | 1.00 | 0.79 | 0.57 | 0.27 |

It can be seen from these results that the square wave response of the samples showed the order of Sample H, Samples E to G Sample D in the space frequency areas examined both in the green layer and in the red layer, i.e., Sample H showed the highest value and Samples E to G followed; the sample showing the lowest value was Sample D which indicated inferior sharpness.

This shows the influence of light scattering based on the fact that the coated amount of Ag was the smallest in the blue sensitive emulsion layer of the Seventh Layer, whereas the coated amount of Ag was the largest in Sample D. It was thus found that use of the yellow coupler which was hardly affected by a competitive coupler was advantageous in the design of such a light sensitive element.

While the invention has been described in detail and with reference to specific embodiments thereof, it will be apparent to one skilled in the art that various changes and modifications can be made therein without departing from the spirit and scope thereof.

What is claimed is:

1. A process for forming color photographic images which comprises applying, after image-wise exposure, a color reversal processing including the step of performing color development in the presence of a competing coupler selected from the group consisting of citrazinic acid, 3,5-dihydroxybenzoic acid, 2,6-dihydroxyisonicotinate, 2,6-dihydroxyisonicotinamide or methyl 3,5-dihydroxybenzoate to a reversal color photographic material comprising a support having coated thereon at least three differently sensitive photographic silver halide emulsion layers, the outermost layer of said color photographic material being blue-sensitive and containing at least one nondiffusible coupler capable of forming a yellow dye by undergoing a coupling reaction with an oxidized primary aromatic amino color developing agent and represented by following general formula (II) or (III)

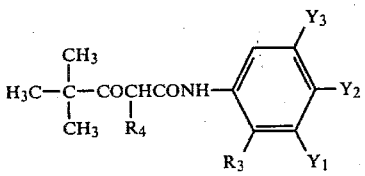

(II)

-continued

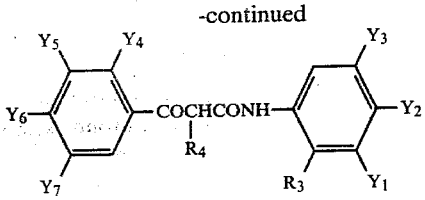

(III)

where $R_3$ represents a halogen atom, an alkyl group, an alkoxy group, an aryloxy group, or a substituted amino group; $Y_1$, $Y_2$ and $Y_3$; which may be the same or different, each represents a hydrogen atom, a halogen atom, an alkyl group, an alkoxy group, an aryl group, an arylamino group, an acylamino group, an alkylsulfonamido group having 8 to 30 carbon atoms, an alkylaminosulfo group having 8 to 30 carbon atoms, a carboxy group, a sulfo group, a cyano group or a hydroxy group; $Y_4$, $Y_5$, $Y_6$ and $Y_7$, which may be the same or different, each represents a hydrogen atom, an alkyl group, an alkoxy group, an aryloxy group, an amino group, an alkylsulfonamido group having 8 to 30 carbon atoms, an alkylaminosulfo group having 8 to 30 carbon atoms or an acylamino group; and $R_4$ represents a group represented by the general formula (IV), (V), (VI) or (VII)

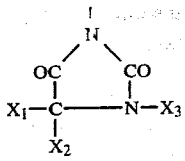

(IV),

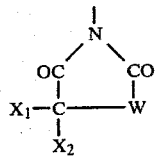

(V),

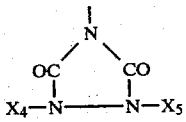

(VI),

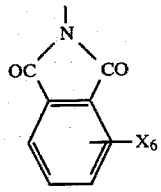

(VII)

wherein $X_1$ and $X_2$, which may be the same or different, each represents a hydrogen atom, an alkyl group, an aryl group, an alkoxy group, an aryloxy group or a hydroxy group; $X_3$, $X_4$ and $X_5$, which may be the same or different, each represents a hydrogen atom, an alkyl group, an aryl group, or an acyl group; W represents an oxygen atom or a sulfur atom; and $X_6$ represents a hydrogen atom, a halogen atom, a nitro group, a cyano group, a thiocyano group, a hydroxy group, an alkoxy group, an aryloxy group, an acyloxy group, an alkyl group, an alkenyl group, an aryl group, an amino group, a carboxy group, an acyl group, an alkoxycarbonyl group, an aryloxycarbonyl group, a carbamoyl group, an acylamino group, an imido group, a sulfo group, an alkylsulfonyl group, an arylsulfonyl group, an alkoxysulfonyl group, an aryloxysulfonyl group, a sulfamoyl group, a sulfonamido group, a ureido group or a thioureido group, wherein one of $Y_1$, $Y_2$ and $Y_3$ is an alkylsulfonamido group having 8 to 30 carbon atoms.

2. The process of forming color photographic images of claim 1, wherein said competing coupler is citrazinic acid.

3. The process for forming color photographic images of claim 1, wherein one of $Y_1$, $Y_2$ and $Y_3$ is an alkylsulfonamido group having 12 to 20 carbon atoms.

4. The process for forming color photographic images of claim 3, wherein one of $Y_1$, $Y_2$ and $Y_3$ is a n-hexadecylsulfonamido group.

5. The process for forming color photographic images of claim 1, wherein said competing coupler is present in a color developing solution in an amount of about $5\times10^{-3}$ to $1.5\times10^{-2}$ mol/liter.

6. The process for forming color photographic images of claim 1, wherein said processing is conducted at a temperature ranging from about 30° C. to about 60° C.

7. The process forming color photographic images of claim 1, wherein said reversed color photographic material further comprises a coupler capable of forming a magenta dye which is represented by the general formula (A)

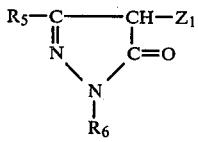

wherein $R_5$ represents a primary, secondary, or tertiary alkyl group, an aryl group, an alkoxy group, an aryloxy group, a heterocyclic group, an amino group, an acylamino group or a ureido group; $R_6$ represents an aryl group, a heterocyclic group or an alkyl group; $Z_1$ represents a hydrogen atom or a group which can be released at color development; and wherein said coupler capable of forming a cyan dye is represented by the general formula (B) or (C)

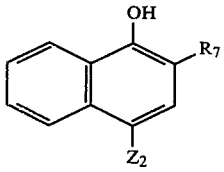

(B)

-continued

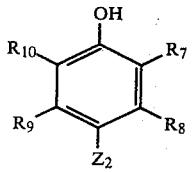

(C)

wherein $R_7$ represents an carbamyl group, a sulfamyl group, an alkoxycarbonyl group or an aryloxycarbonyl group; $R_8$ represents an alkyl group, an aryl group, a heterocyclic group, an amino group, a carbamido group, a sulfamido group, a sulfamyl group or a carbamyl group; $R_8$, $R_9$ and $R_{10}$ each represents a group as defined for $R_7$ and further represents a halogen atom or an alkoxy group; and $Z_2$ represents a hydrogen atom or a group which can be released at color development.

8. The process for forming color photographic images of claim 7, wherein said non-diffusible coupler has general formula (II).

9. The process for forming color photographic images of claim 8, wherein said non-diffusible coupler has general formula (III).

10. The process for forming color photographic images of claim 8, wherein $R_4$ has formula (V) wherein W is oxygen.

11. The process for forming color photographic images of claim 8, wherein $R_4$ has formula (IV).

12. The process for forming color photographic images of claim 9, wherein one of $Y_1$, $Y_2$ and $Y_3$ is an alkysulfonamido group having 12 to 20 carbon atoms.

13. The process for forming color photographic images of claim 12, wherein $Y_1$ is said alkylsulfonamido group.

14. The process for forming color photographic images of claim 12, wherein $Y_2$ is said alkylsulfonamido group.

15. The process for forming color photographic images of claim 12, wherein $Y_3$ is said alkylsulfonamido group.

16. The process for forming color photographic images of claim 9, wherein one of $Y_1$, $Y_2$ and $Y_3$ is a n-hexadecylsulfonamido group.

17. The process for forming color photographic images of claim 13, wherein $Y_1$ is a n-hexadecylsulfonamido group.

18. The process for forming color photographic images of claim 14, wherein $Y_2$ is a n-hexadecylsulfonamido group.

19. The process for forming color photographic images of claim 15, wherein $Y_3$ is a n-hexadecylsulfonamido group.

20. The process for forming color photographic images of claim 7, wherein said competing coupler has the formula

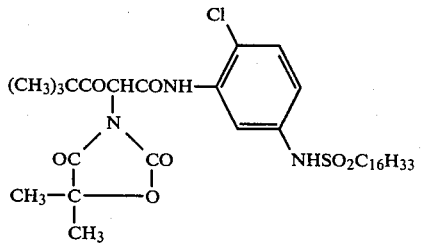

21. The process for forming color photographic images of claim 7, wherein said competing coupler has the formula

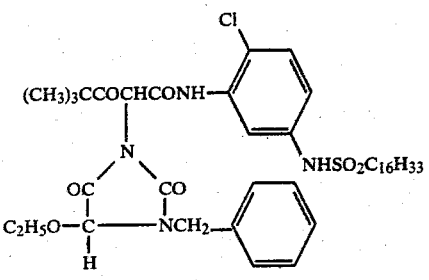

22. The process for forming color photographic images of claim 10, wherein $Y_1$ is said alkylsulfonamido group.

23. The process for forming color photographic images of claim 11, wherein $Y_1$ is said alkylsulfonamido group.

24. The process for forming color photographic images of claim 7, wherein said competing coupler is citrazinic acid which is used in an amount of 1.2 to 10 g/l, said magenta coupler is 1-(2,4,6-trichlorophenyl)-3-[3-(2,4-di-t-amylphenoxyacetamido)-benzamido]-5-pyrazolone, and said yellow coupler is:

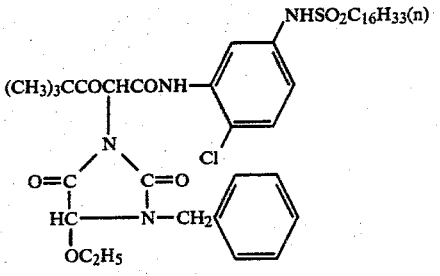

* * * * *